United States Patent [19]

Maus

[11] 4,453,345

[45] Jun. 12, 1984

[54] WINDOW AND DOOR MOUNTING

[75] Inventor: Julius Maus, Stuttgart, Fed. Rep. of Germany

[73] Assignee: Gretsch-Unitas GmbH Baubeschlagfabrik, Fed. Rep. of Germany

[21] Appl. No.: 286,176

[22] Filed: Jul. 23, 1981

[30] Foreign Application Priority Data

Jul. 23, 1980 [DE] Fed. Rep. of Germany ..... 3027835

[51] Int. Cl.[3] ..... E05D 15/50; E05D 15/22

[52] U.S. Cl. ..... 49/193; 49/176; 49/187

[58] Field of Search ..... 49/193, 192, 176, 187, 49/221, 223, 260, 217, 218, 219, 220, 222, 257, 254, 381

[56] References Cited

U.S. PATENT DOCUMENTS

| | | | |
|---|---|---|---|
| 1,980,275 | 11/1934 | Julin | 49/187 X |
| 2,374,618 | 4/1945 | Perreton | 49/193 X |
| 2,764,784 | 10/1956 | McCall | 49/217 X |
| 3,867,790 | 2/1975 | Frank | 49/381 |
| 3,911,621 | 10/1975 | McHeffey | 49/192 |

FOREIGN PATENT DOCUMENTS 2145140 12/1973 Fed. Rep. of Germany ..... 49/219

*Primary Examiner*—Philip C. Kannan

*Attorney, Agent, or Firm*—McGlew and Tuttle

[57] ABSTRACT

A mounting is disclosed for the movable member of a window or door in a fixed frame which comprises four set-off arms connected to corners of the movable member. Each set-off arm is pivoted and slidably mounted to the movable member at one end thereof and pivotally mounted to the frame in an opposite end thereof. An auxiliary arm is pivotally mounted to the set-off arm at an intermediate location thereon and also to the movable member. The set-off arms take up opposite mirror image inclined positions with the movable member in its closed and opened position respectively. The upper set-off arms are mirror images of the lower set-off arms about a plane perpendicular to the plane of the movable member with the pivotal and sliding engagement between upper and lower set-off arms being closer to each other than the pivotal engagement between those set-off arms and their associated auxiliary arms.

12 Claims, 9 Drawing Figures

WINDOW AND DOOR MOUNTING

FIELD AND BACKGROUND OF THE INVENTION

The present invention relates in general to window and door mountings and in particular to a new and useful mounting for a movable member which can either be a window or door which member can be tilted into a tilted position away from its frame or moved into an offset position which is parallel to the plane of the frame but offset away from the plane of the frame. Such doors or windows having movable members, in particular a movable sash, are mounted to the fixed frame jamb through four mounting assemblies, two at the top and two at the bottom. Such assemblies can be termed set-off arms since they cause a top edge of the sash to be set off or away from the frame or both the bottom and top edges of the sash to be set off away from the frame. To tilt the movable member, more particularly the sash, only the upper set-off arms on the left and right are spread, while the lower set-off arms remain in their original position relative the sash. To set the sash off into a parallel position, all four of the set-off arms are spread. The prior art sash is a part of a sliding or hung window and is commonly suspended from cables. This construction however, is not suitable for sashes which are not supported by cables, because of the strong force needed for their displacement and the unfavorable load on the set-off arms and a taking up of the weight.

SUMMARY OF THE INVENTION

The invention is directed to the mounting of a movable member in a fixed frame of the above mentioned kind which, even if heavy, can be displaced without applying great force and with which the occurring forces are taken up in a proper way. To this end, the movable member or sash is mounted on four set-off arms to the fixed frame so that the sash can be placed in a tilted position or in a parallel offset position. Each of the set-off arms is mounted on the sash for pivoting and displacement and carries an auxiliary arm which is pivoted about the sash and to the set-off arm itself. With the set-off arm occupying an inclined position relative to the plane of the sash, both in a closed and in a parallel offset position, and with the two inclined positions being symmetrical mirror inverted images of each other, the mounting of each of the upper and associated lower set-off arms is symmetrical relative to a plane perpendicular to the plane of the sash in its closed position, with the pivotal axis of the set-off arms on the sash for the upper and lower parts of the sash being closer to each other than the pivotal axes of the auxiliary arms to the sash.

Considering the usual spacing in the parallel off-set position, the set-off arm and the auxiliary arm be so dimensioned and mounted that their longitudinal axes are only slightly inclined relative to the plane of the wing or sash, both in the closed and the parallel offset position and this also applies to the top setting of the arms in the tilted position. A favorable absorption of the weight of the sash by the frame is thereby obtained, so that no problems with the loading of the supporting parts arise, not even with high weights of the sash. In addition, during a motion both into and back from the parallel position, the center of gravity of the sash moves substantially along a horizontal line, wherefore, a minimum force is to be applied.

Another essential advantage is that identical tongs comprising a set-off arm and an auxiliary arm can be employed for both the upper and the lower corners. This simplifies mass production and thus lowers costs. Tilting, setting apart, and resetting of the sash may be done manually or by means of a suitable operator. The set-off arms are supported on the fixed frame of the window or door through rolling or sliding elements, in particalr to ends of the set-off arms which are closest to the fixed frame. If the sash is to be shifted or slid in its parallel offset position, for example along another sash or window pane which is fixed, rolling elements such as rollers or roller pairs will advantageously be provided at the lower set-off arms, and sliding elements, such as a guide shoe, for the upper set-off arms. In such an instance, the roller would cooperate with track rails and the sliding elements with a suitable guide rail.

A preferred embodiment of the invention therefore provides that the lower set-off arms are supported through at least one roller, preferably a pair of rollers, on a track rail or the like, with the rollers or roller being mounted on a roller carrier to which the set-off arm end closest to the fixed frame is pivoted. The rollers or pairs of rollers remain on or in their track rail in any position of the sash, and for tilting or parallel setting, the set-off arm is pivoted relative to the roller carrier. A similar sliding element carrier of course is provided at the upper set-off arms which is pivotable relative thereto. The pivotal planes of the arms extend perpendicularly to the plane of the sash, because of the lateral arrangement of both the set-off and the auxiliary arms.

Another development of the invention provides that the two roller carriers of the lower set-off arms are connected to each other by a bar-shaped or tube-shaped member particularly a member designed for being interengaged. This may be done by providing a mandrel-shaped extension on the lower carrier, on which the connecting member is engaged.

A particularly preferred provision is that on each of the horizontal members of the sash or sash frame, a control stud is provided which is associated with a respective set-off arm and is actuatable by means of a drive rod. The control studs together with transmission members mounted on this horizontal member of the frame, form a control device for adjusting the sash, with the upper and lower control studs moving in opposite directions while being displaced simultaneously, and the upper control studs being movable without moving the lower ones, while the lower control studs cannot be moved without moving the upper ones. For example, while moving control studs of the lower left corner from the right to the left, the upper left control stud moves simultaneously from the left to the right. This makes it possible to employ identical fittings, comprising the mentioned component parts, for diagonally opposite corners, with the upper and lower ones facing each other symmetrically. In the other diagonal, the fittings will be of a "right-hand" design as compared to the "left-hand" design of those of the first diagonal. If all the four control studs are moved simultaneously, for example, the two lower ones from the left to the right and the upper ones from the right to the left, the sash is set off in parallel. A motion of the studs in opposite directions of course, will result in a closing of the sash. By actuating only the upper studs, only the upper end of the sash is moved outwardly and the tilted position is obtained. It is particularly advantageous in this connection if the drive rod of the lower control studs is connected to the drive rod of the upper control studs through a coupling device. This coupling device may be a relatively simple mechanism, particularly a manually operated one.

Still another developmment of the invention provides that the control stud engages an arcuate control slot of a first pivoting member which cooperates with a second pivoting member in the manner of a toggle connection with both of the pivoting members being mounted on a horizontal frame portion of the sash and being pivotable in a plane which is perpendicular to both the plane of the sash and the pivotal plane of the associated set-off arm, with the second pivoting member being hinged to a control bar having one end mounted for pivoting and sliding in the horizontal member of the sash and its other end mounted for pivoting on the set-off arm. The control stud is connected to a drive rod in a manner known per se, and executes a linear motion along the upper horizontal sash frame member. The size of the arcuate slot is such that the maximum displacement of the control slot brings the sash from the closed position into the parallel offset or tilted position and vice versa.

According to a further development of the invention, the control bar is pivoted to the set-off arm through a spherical joint.

Another preferred feature of the invention provides that the control bar in the first and second pivoting members are mounted on a leg of a corner angle fitted to the corner of the sash, and that the offset arm and the auxiliary arm are hinged to the other leg of the corner angle. This design has the advantage that all parts needed for the controled setting and resetting of the sash can be preassembled and secured to the sash or corner thereof as a unit. Then, it is particularly advantageous if the corner angle forms a part of a corner rail for the drive rod so that upon securing the four corner angles, it remains only to mount the drive rod extensions and the actuating mechanism with the coupling device.

To handle also forces which occur with very heavy sashes or movable members it is particularly advantageous to couple the first and second pivoting members to each other through a gearing or a similar means.

Accordingly, it is a further object of the invention to provide a window or door mounting which mounts a movable member to a fixed frame which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

One embodiment of the invention is shown in the drawings in which.

DESCRIPTION OF THE PREFERRED EMBODIMENT

Figure 1:
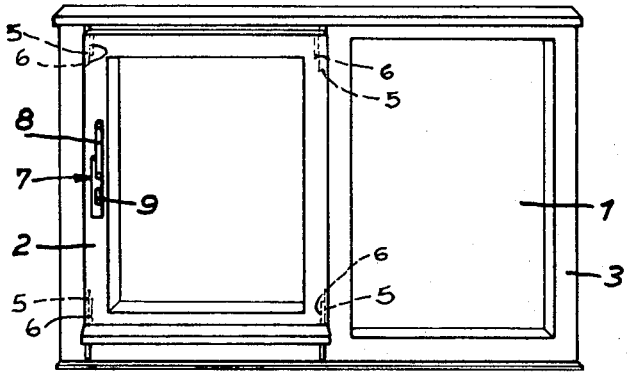
FIG. 1 is a front elevational view of a window having one sash which is mounted for tilting, or for parallel motion away from the window plane so that the sash can be slid sideways.

Turning to the drawings in particular, the invention embodied therein as shown in FIG. 1, comprises a movable member such as a window sash 2 which is movably mounted to a fixed frame 3. The movable member 2 is mounted at its four corners to the four corners of a corresponding opening in the fixed frame 3.

Figure 5:
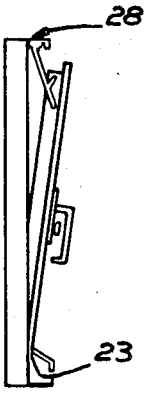
Figure 3:
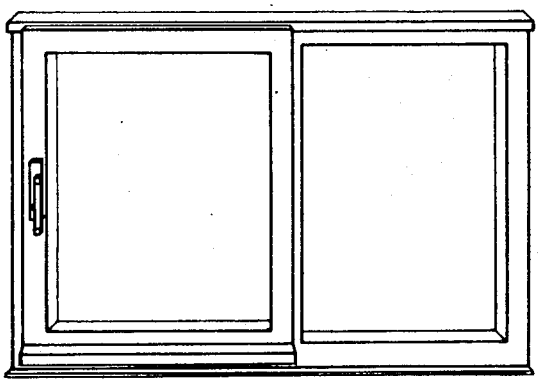
FIG. 3 is a view similar to FIG. 1, showing the sash in an off set parallel position.
Figure 6:
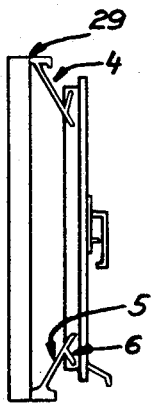

The window comprises a fixed pane 1, a movable sash or member 2, and a fixed frame 3. The movable sash 2 is supported on fixed frame 3, at each of its four corners, by means of a set-off tongs 4 comprising a set-off arm 5 and auxiliary arm 6. The upper tongs are mounted in mirror-image symmetry relative to the lower ones as shown in FIG. 6. If only the upper tongs are spread, the sash is moved into its tilted position (FIG. 5). By spreading all four tongs, the sash comes into its parallel off set position in which it may be shifted or slid along fixed pane 1. To switch from one to the other mode, or position of sash 2, an operating mechanism 7 with a handle 8 and an additional switching mechanism with a control member 9, are provided. For additional details of this mechanism, see the co-pending application entitled control MECHANISM FOR A WINDOW OR DOOR by the present inventor.

Figure 9:
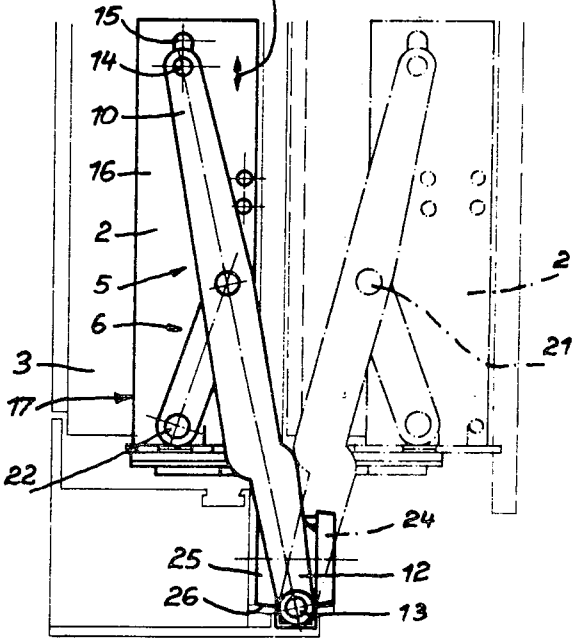
FIG. 9 is a view taken in the direction of arrow B of FIG. 7.
Figure 8:
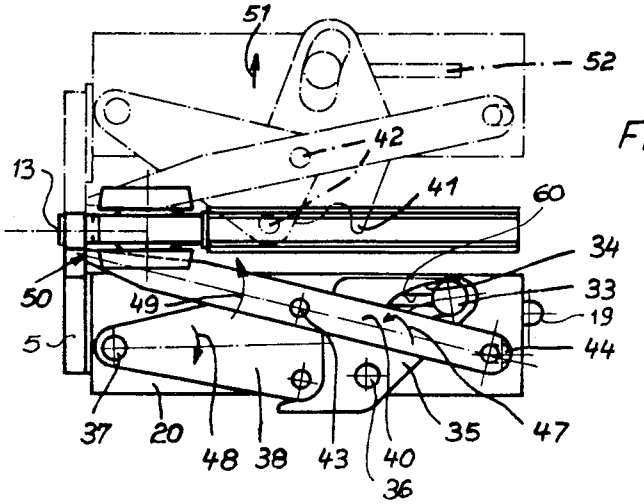
FIG. 8 is a view taken in the direction of arrow A of FIG. 7.
Figure 7:
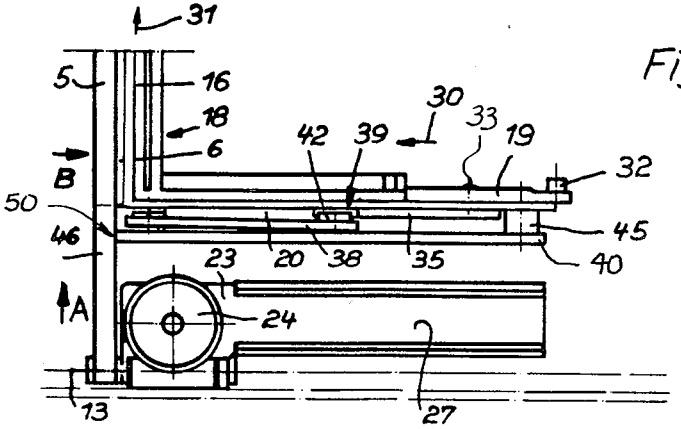
FIG. 7 is an enlarged fragmentary view showing a fitting of the lower left corner of the sash.

In FIG. 9, the sash 2 is indicated in closed position in solid lines and in the parallel off-set position, in dot-dash lines. The showing in FIG. 8 is similar. One end 10 of set-off arm 5 is povitally mounted on the sash and also mounted for displacement in the direction of double arrow 11, while the other end 12 is hinged to fixed frame 3 for pivotal motion about an axis 13. A pivot pin 14 on end 10 engages an oblong groove 15 which is provided in a leg 16 of a corner angle 17. Angle 17 forms a part of a corner rail 18 for a drive rod 19 having also another leg 20 (FIG. 7). While only one mounting of one corner is described in detail, the other three are the same except that they are mirror images about a vertical or horizontal plane. Set-off arm 5, and auxiliary arm 6 are hinged to each other at 21. The end of auxiliary arm 6 which is remote from set-off arm 5, is hinged at 22 to a movable sash 2. The particular arm 6 is mounted to leg 16 of rail 18 which is secured to the respective corner thereof. Auxiliary arm 6 extends between set-off arm 5 and leg 16 of the angle 18. Two set off tongs are thus provided between the left and right vertical members or jambs of the movable sash and the fixed frame.

The hinge pin 13 of the other end 12 of set-off arm 5 is supported on a roller carrier 23 which is equipped with a roller 24, 25 both on the left and right side of the sash 2. These rollers bear against a track rail 26 of the fixed frame 3. To prevent bending of set-off arms 5 under the inertial forces occurring during a displacement, an extension (not shown) is secured to a leg or tube member 27 of roller carrier 23, which extension reaches up to the opposite leg 27 of the roller carrier 23 of the lower right corner of the sash, and establishes a connection. The set-off arms 5 of both upper tongs each carry a sliding shoe holder 28 (not shown in detail) engaging a guide rail 29, for longitudinal displacement.

Sash 2 with its mountings can thus be slid side-ways along tracks or rails 29 and 26 when the sash is in its off-set parallel position.

Figure 4:
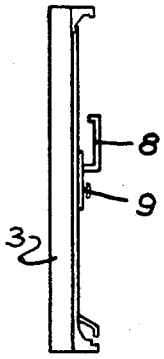
FIGS. 4, 5 and 6 respectively are side elevational views of FIGS. 1, 2 and 3.
Figure 2:
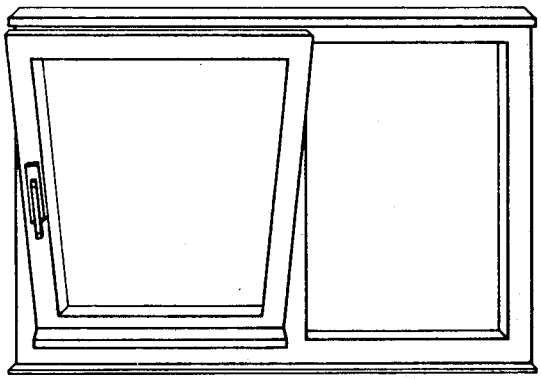
FIG. 2 is a view similar to FIG. 1 showing the sash in a tilted position.

The two shoe holders may be connected to each other, as are roller carriers 23 (see FIGS. 4 to 6). Aside from the right hand and left hand mirror image design, this is the sole difference between the fittings on the upper and lower corners. Consequently, quasi-identical fittings can be used for the upper and lower corners, only mounted in mirror inverted positions. To obtain the parallel off-set position, lower drive rod 19, must move in the direction of arrow 30 and the corresponding upper drive rod which is parallel thereto, must move in the opposite direction. Then, the connecting rod of the left hand vertical frame member of the sash moves from below upwardly, thus in the direction of arrow 31. A prerequisite for an accurately parallel setting off motion, is that tongs 4 occupy, in their parallel positions, a mirror-image position relative to their position with the sash closed, as shown in FIG. 9 (see the solid lines as compared to the dot-dash lines). The set-off and auxiliary arms thus have mirror-image Y-shaped configurations in their open and closed positions.

Drive rod 19 which carries a pin 32 for engaging an extension rod leading to the corner rail at the lower right side of the sash also carries a control stud 33 (FIG. 8). Stud 33 engages a control slot 34 of a first pivoting member 35 which is pivoted at 36 to the outside of leg 20 of the corner angle 18. A second pivoting member 38 is pivoted at 37 to the same angle leg 20, only with more spacing therefrom than member 35 (see FIG. 7). The two pivoting members 35 and 38 are coupled to each other through a gearing 39 and operate in the manner of a toggle on a control bar 40. The gearing, for example, comprises teeth 41 on first pivoting member 35 and rollers 42 or bolts on second pivoting member 38 acting as opposite mating teeth. The two extreme positions of the first and second pivoting members relative to each other are shown in FIG. 8 in solid and dot-dash lines respectively. The solid lines correspond to the closing position according to FIG. 9, while the dotted lines indicate the parallel set-off position, which also corresponds to the tilted position as far as the upper end of the sash is concerned. Control rod 40 is connected to second pivoting member 38, and thus indirectly to first pivoting member 35, by means of a pivot pin 43. The right hand end (FIG. 8) of control bar 40 carries a pin 45 by which it is rotatably and displaceably guided in an oblong slot 44 of angle leg 20. The other end of control bar 40 engages a recess (not shown) of set-off arm 5 which is located about intermediate hinges 13 and 21. A particular embodiment of this connection between control bar 40 and arm 5 is a universal joint 50, for example a spherical ball and socket joint.

Control bar 40 is designed as a straight bar equipped with the mounting elements on both ends as described, and the pivot pin 43 about in the middle. Second pivoting member 38 has substantially the shape of an acute isosceles triangle, with the coupling rollers 42 and the pivotal axes 37, 43 being located in the corners thereof, as shown in FIG. 8. In the closed position of the sash, the axis of symmetry of the triangle extends about parallel to the longitudinal direction of angle leg 20. The arcuate control slot 34 of pivoting member 35 is curved only slightly, as shown in FIG. 8, and its length is approximately three times the diameter of control stub 33. The interlinkage of the control rods 19 is shown in FIG. 1 in chain line.

By displacing drive rod 19 in the direction of arrow 30, first pivoting member 35 is turned about its axis 36 in the direction of arrow 47. The first pivoting member 35 imparts rotary motion to the second pivoting member 38 which then turns about its axis of rotation 37 in the direction of arrow 48, i.e. the knee formed by the two members, buckles. At the same time, second pivoting member 38 causes a relative rotary motion in the direction of arrow 49 of control bar 40 about joint 50 at set-off arm 5, which is pivoted along with arm 5 about axis 13. The sash is displaced through hinge pin 45, in the direction of arrow 51.

The sash is reset by shifting the drive rods 19 in the direction opposte to arrow 30. It is to be noted in addition that control stud 33 extends through a guide slot of angle leg 20 at 60 in FIG. 8. The vertical drive rod which can be shifted by handle 8 is parted (not shown) at the closing side of sash 2, and the two parts can be coupled to or disengaged from each other by means of a coupling device or clutch (not shown). The coupling engagement is effected by turning control member 9 through about 90°. Due to this design, the lower drive rod 19 can be shifted only upon engaging the coupling device in advance, by means of control member 9. The upper vertical drive rod, on the contrary, is permanently coupled to the coupling device 7 (see the copending application for details).

With the exception of corner angle 17, all parts for the left hand and right hand fittings are of identical design, only they are mounted partly in a position turned through 180° as pivoting member 35, for example.

While a specific embodiment of the invention has been shown and described in detail to illustrate the application of the principles of the invention, it will be understood that the invention may be embodied otherwise without departing from such principles.

What is claimed is:

1. A mounting for a movable member in a fixed frame comprising:

a set-off arm pivotally and slidably mounted to the movable member at one end thereof and pivotally mounted to the frame at an opposite end thereof;

an auxiliary arm pivotally mounted at one end thereof to the movable member and at an opposite end thereof to said set-off member at a location intermediate the opposite ends of said set-off member;

the movable member being movable from a first position in the frame to a second position spaced from the frame, with said set-off arm having mirror image opposite inclined positions with respect to the plane of the movable member with the movable member in its first and second positions respectively, said set-off arm and auxiliary arm having Y-shaped mirror image configurations in said first and second positions of said movable member.

2. A mounting according to claim 1 wherein the movable member includes at least one additional set-off arm and auxiliary arm connected thereto at an opposite end thereof from said former mentioned set-off arm and auxiliary arm, said former mentioned and additional set-off and auxiliary arms being mounted between the movable member and the frame in a symmetrical manner with respect to each other about a plane substantially perpendicular to the plane of the movable member extending between said former mentioned and additional set-off and auxiliary arms, said one end of said former mentioned set-off arm pivotally and slidably mounted to the movable member being closer to a corresponding one end of said additional set-off arm than respective pivotal connections between each of said set-off arms and their respective auxiliary arms, whereby the movable member can be moved into a tilted second position with only one of said set-off arms moved, and a parallel second position with both of said set-off arms moved.

3. A mounting for a movable member in a fixed frame comprising:

a set-off arm pivotally and slidably mounted to the movable member at one end thereof and pivotally mounted to the frame at an opposite end thereof;

an auxiliary arm pivotally mounted at one end thereof to the movable member and at an opposite end thereof to said set-off member at a location intermediate the opposite ends of said set-off member;

the movable member being movable from a first position in the frame to a second position spaced from the frame, with said set-off arm having mirror image opposite inclined positions with respect to the plane of the movable member with the movable member in its first and second positions respectively, slide mounting means connected between said opposite end of said set-off arm and the fixed frame for permitting lateral sliding of the movable member on said slide mounting means with the movable member in its second position, said slide mounting means comprising a roller track connected to said frame extending in a direction of sliding of the movable member, a roller carrier to which said opposite end of said set-off arm is pivoted and a roller rotatably mounted to said roller carrier and engaged in said roller track;

said set-off arm and auxiliary arm being connected to one bottom corner of the movable member; and one additional set-off arm and auxiliary arm connected to an opposite bottom corner of the movable member, each of said first mentioned and additional set-off arms pivotally mounted to a roller carrier with a tube member for interconnecting said roller carrier of said first-mentioned and additional set-off arms.

4. A mounting according to claim 3, wherein said set-off arm and auxiliary arm are connected to a lower side of the movable member, said roller carrier carrying said former mentioned and one additional roller, both of said former mentioned and additional rollers riding in said roller track to support the movable member for sliding motion with respect to the frame.

5. A mounting for a movable member in a fixed frame comprising:

a set-off arm pivotally and slidably mounted to the movable member at one end thereof and pivotally mounted to the frame at an opposite end thereof;

an auxiliary arm pivotally mounted at one end thereof to the movable member and at an opposite end thereof to said set-off member at location intermediate the opposite ends of said set-off member;

the movable member being movable from a first position in the frame to a second position spaced from the frame with said set-off arm having mirror image opposite inclined positions with respect to the plane of the movable member with the movable member in its first and second positions respectively, said set-off arm and said auxiliary arm being pivotally mounted to a vertical side of the movable member;

the movable member having a horizontal frame portion, a drive rod slidably engaged to said horizontal frame portion having a control stud connected thereto; and transmission means connected between said stud and said set-off arm mounted to said horizontal frame portion so that movement of said drive rod along said horizontal frame portion causes pivotal movement of said set-off arm about its pivotal connection with the fixed frame to move the movable member from its first to its second position.

6. A mounting according to claim 5, wherein said transmission means comprises a first pivoting member pivotally mounted to said horizontal frame portion having an arcuate slot therein which receives said control stud, a second pivoting member pivotally mounted to said horizontal frame portion and engaged with said first pivoting member for pivoting of said second pivoting member with pivotal motion of said first pivoting member, said first pivoting member being pivotal by movement of said control stud in said arcuate slot, both said first and second pivoting members being pivotal to said horizontal frame portion in a plane perpendicular to the plane of the movable member and the pivotal plane of said set-off and auxiliary arms, and a control bar pivotally mounted to said second pivoting member at an intermediate position along the length of said control bar, said control bar pivotally and slidably connected to said horizontal frame portion at one end thereof and pivotally mounted to said set-off arm at an opposite end thereof.

7. A mounting according to claim 6, wherein said control bar is pivotally mounted to said set-off arm through a joint.

8. A mounting according to claim 7, wherein said first pivoting member is engaged to said second pivoting member through gear means for transmitting pivotal movement of said first pivoting member into pivotal movement of said second pivoting member.

9. A mounting according to claim 6, wherein said pivotal connection between said control bar and said set-off arm is at a position of said set-off arm between said set-off arm opposite end pivotally mounted to the fixed frame and said pivotal connection between said set-off arm and said auxiliary arm.

10. A mounting according to claim 9, wherein said second pivoting member has the shape of an acute isosceles triangle, with an acute angle of said triangle pivotally mounted to said horizontal frame portion, one base single of said triangle pivotally mounted to said control bar and another base angle of said triangle engaged to said first pivoting member.

11. A mounting according to claim 6, including a corner angle member connected to a corner of the movable member, said set-off and auxiliarly arms pivotally mounted to a vertical leg of said corner angle member and said drive rod and transmission means mounted to a horizontal leg of said corner angle member.

12. A mounting according to claim 11, wherein said corner angle member comprises a corner rail for slidably receiving said drive rod.

* * * * *